US010029251B2

(12) United States Patent
Seo et al.

(10) Patent No.: US 10,029,251 B2
(45) Date of Patent: Jul. 24, 2018

(54) DROPLET FORMING APPARATUS

(71) Applicants: Manabu Seo, Kanagawa (JP); Yoshio Uchikata, Kanagawa (JP); Daisuke Takagi, Kanagawa (JP); Yuzuru Kuramochi, Tokyo (JP)

(72) Inventors: Manabu Seo, Kanagawa (JP); Yoshio Uchikata, Kanagawa (JP); Daisuke Takagi, Kanagawa (JP); Yuzuru Kuramochi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 138 days.

(21) Appl. No.: 14/959,011

(22) Filed: Dec. 4, 2015

(65) Prior Publication Data

US 2016/0175834 A1 Jun. 23, 2016

(30) Foreign Application Priority Data

Dec. 22, 2014 (JP) ..... 2014-259120

(51) Int. Cl.
*B01L 3/02* (2006.01)

(52) U.S. Cl.
CPC ..... *B01L 3/0268* (2013.01); *B01L 2200/0684* (2013.01); *B01L 2300/041* (2013.01)

(58) Field of Classification Search
CPC ..... B01L 3/0268; B01L 2200/0684; B01L 2300/041
See application file for complete search history.

(56) References Cited

U.S. PATENT DOCUMENTS

| | | | | |
|---|---|---|---|---|
| 5,518,179 | A | 5/1996 | Humberstone et al. | |
| 6,338,545 | B1 | 1/2002 | Sekiya | |
| 2002/0168297 | A1* | 11/2002 | Shvets et al. | B01L 3/021 422/400 |
| 2004/0256318 | A1* | 12/2004 | Iida et al. | B01D 57/02 210/634 |
| 2010/0201765 | A1 | 8/2010 | Paku et al. | |
| 2012/0092418 | A1 | 4/2012 | Chen et al. | |

FOREIGN PATENT DOCUMENTS

| | | |
|---|---|---|
| EP | 1205247 | 5/2002 |
| JP | 2849647 | 1/1999 |
| JP | 2006-289984 | 10/2006 |
| WO | 97/12689 | 4/1997 |
| WO | 2011/077120 | 6/2011 |

OTHER PUBLICATIONS

"Technology of tissue culture edited by the Japanese Tissue Culture Association, third edition", Asakura Publishing Co., Ltd., pp. 581-583.
Extended European Search Report dated Aug. 4, 2016.
Chinese Office Action for 201510940220.7 dated Jun. 20, 2017.

* cited by examiner

*Primary Examiner* — Gautam Prakash
(74) *Attorney, Agent, or Firm* — IPUSA, PLLC

(57) ABSTRACT

A droplet forming apparatus includes a liquid retaining portion that retains cell suspension containing cells; a membrane member, provided with a nozzle, that discharges the cell suspension retained in the liquid retaining portion from the nozzle as a droplet by oscillation; and an open portion that opens the liquid retaining portion to atmosphere.

7 Claims, 7 Drawing Sheets

DROPLET FORMING APPARATUS

BACKGROUND OF THE INVENTION

1. Field of the Invention

The present invention relates to a droplet forming apparatus.

2. Description of the Related Art

Recently, in accordance with a development of a stem cell technology, a technique has been developed in which an organizational body is formed by discharging a plurality of cells by inkjet. As the types of inkjet, a piezoelectric pressure type using a piezoelectric element, a thermal type using a heater, an electrostatic type in which liquid is attracted by an electrostatic attraction or the like may be raised. Among these, it is preferable to use the piezoelectric pressure type for forming a droplet of cell suspension because damages due to heat or an electrical field are harder to be caused to cells by this type compared with other types.

In an inkjet head of a conventional general piezoelectric pressure type, a droplet is formed using compression of liquid in a pressure liquid chamber. Thus, there has been a problem that, if bubbles are mixed in the pressure liquid chamber, the liquid cannot be compressed and the liquid cannot be discharged. For the cell suspension, water is used as solvent. However, a surface active agent that is generally used in a general inkjet ink cannot be used because the surface active agent may cause damages to the cells. Thus, there is a problem that the bubbles are easily mixed in the pressure liquid chamber due to its high surface tension.

Further, in a general inkjet head, in order to remove the bubbles and recover to a normal state, the bubbles are removed with large amount of liquid from a nozzle portion by pressurizing the liquid chamber, or aspirating the liquid from the nozzle portion. However, as the cell suspension is more expensive and valuable compared with general inkjet ink, it is not preferable to remove the bubbles by this method.

Meanwhile, a droplet manufacturing apparatus is disclosed in which liquid on a film is atomized by oscillating the film by a bending mode actuator. In this apparatus, it is possible to directly disperse the liquid formed on the film without using a pressurizing force in the liquid chamber. Thus, compared with a general inkjet head, influence of the bubbles can be reduced (see Patent Document 1, for example).

However, when such an apparatus as described above is used for forming a droplet of cell suspension, as the specific frequency of the film shifts due to the existence of the bubbles remaining in the liquid chamber, there is influence in a droplet forming state if the bubbles of more than or equal to a predetermined amount are mixed. Thus, it is difficult to stably discharge the cell suspension for a long period.

Patent Document

[Patent Document 1] Japanese Patent No. 2,849,647

SUMMARY OF THE INVENTION

The present invention is made in light of the above problems, and provides a droplet forming apparatus capable of stably discharging cell suspension.

According to an embodiment, there is provided a droplet forming apparatus including a liquid retaining portion that retains cell suspension containing cells; a membrane member, provided with a nozzle, that discharges the cell suspension retained in the liquid retaining portion from the nozzle as a droplet by oscillation; and an open portion that opens the liquid retaining portion to atmosphere.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Figure 1:
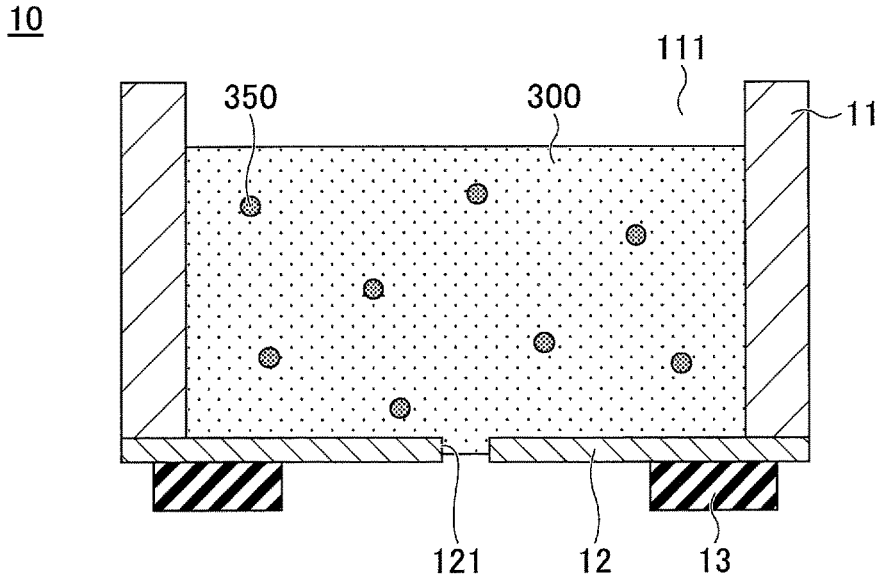
FIG. 1 is a cross-sectional view illustrating an example of a droplet forming apparatus of a first embodiment.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

First Embodiment (Structure of Droplet Forming Apparatus)

A droplet forming apparatus of a first embodiment is described. FIG. 1 is a cross-sectional view illustrating an example of a droplet forming apparatus 10 of the first embodiment. With reference to FIG. 1, the droplet forming apparatus 10 includes a liquid chamber 11, a membrane 12 and a piezoelectric element 13. In FIG. 1, a state is schematically illustrated in which cell suspension 300 containing cells 350 is retained in the liquid chamber 11.

In this embodiment, a liquid chamber 11 side is referred to as an upper side, and a piezoelectric element 13 side is referred to as a lower side, for the purpose of explanation. Further, in each component, a surface at the liquid chamber 11 side is referred to as an upper side, and a surface at the piezoelectric element 13 side is referred to as a lower side. Further, "in a plan view" means that an object is seen in a direction that is normal to an upper surface of the membrane 12, and a "plan shape" means a shape of an object seen in the direction that is normal to an upper surface of the membrane 12.

In the droplet forming apparatus 10, the liquid chamber 11 is a liquid retaining portion that retains the cell suspension 300 containing the cells 350 (in which the cells 350 are dispersed), and may be formed by, for example, metal, silicon, ceramic or the like. The liquid chamber 11 is provided with an open portion 111 at its upper portion for opening the liquid chamber 11 to atmosphere. As such, the liquid chamber 11 is configured as being capable of ejecting bubbles mixed in the cell suspension 300 from the open portion 111.

The membrane 12 is a membrane member that is fixed at a lower end portion of the liquid chamber 11. The membrane 12 is provided with a nozzle 121, which is a through hole, at its approximately center. The cell suspension 300 retained in the liquid chamber 11 is discharged from the nozzle 121 as a droplet by an oscillation of the membrane 12. The plan shape of the membrane 12 may be, for example, a circle, an ellipse shape, a quadrangle (square shape) or the like.

Although the material of the membrane 12 is not specifically limited, if the membrane 12 is too soft, the membrane 12 is easily oscillated and it is difficult to immediately suppress the oscillation when the droplet should not be discharged. Thus, it is preferable that a material with a certain hardness is used. As the material of the membrane 12, for example, a metal material, a ceramic material, a high polymer material with a certain hardness or the like may be used. Further, in particular, it is preferable to use a material whose adhesion property to the cells 350 is low.

It is said that, generally, the adhesion property of a material to cells depends on an angle of contact of the material with water. It is said that if hydrophilicity of the material is high or hydrophobicity of the material is high, the adhesion property of the material to cells is low. As the material whose hydrophilicity is high, various metal materials or ceramic (metal oxide) may be used. As the material whose hydrophobicity is high, fluororesin or the like may be used.

As an example of such a material, stainless steel, nickel, aluminium, silicon dioxide, alumina, zirconia or the like may be used. In addition to this, the adhesion property of a material to cells may be lowered by coating a surface of the material. Thus, it is possible to coat a surface of a material by the above described metal, the metal oxide material, or a synthesized phospholipid polymer ("LIPIDURE" manufactured by NOF CORPORATION, for example) that imitates a cell membrane.

It is preferable that the nozzle 121 is provided at an approximately center of the membrane 12 as an approximately circle shaped through hole. In this case, the diameter of the nozzle 121 is not specifically limited, however, it is preferable that the diameter is greater than or equal to two times of the size of each of the cells 350 in order to avoid that the cells 350 are blocked by the nozzle 121. Specifically, as the size of an animal cell, in particular, a human cell is generally about 10 μm to 30 μm, it is preferable that the diameter of the nozzle 121 is greater than or equal to 20 μm to 60 μm in accordance with the size of the used cells.

On the other hand, if the droplet becomes too large, it is difficult to achieve a purpose to form a micro droplet, so it is preferable that the diameter of the nozzle 121 is less than or equal to 200 μm. This means that the diameter of the nozzle 121 is typically within a range of 20 μm to 200 μm in the droplet forming apparatus 10 of the embodiment.

The piezoelectric element 13 is provided at a lower surface side of the membrane 12. The shape of the piezoelectric element 13 may be designed in accordance with the shape of the membrane 12. For example, when the plan shape of the membrane 12 is a circle, it is preferable to form the piezoelectric element 13 whose plan shape is a circular shape (a ring shape) around the nozzle 121.

The piezoelectric element 13 has a structure in which electrodes for applying voltage are provided at an upper surface and a lower surface of a piezoelectric material, respectively, for example. By applying the voltage to the upper and lower electrodes of the piezoelectric element 13, a compressive stress is generated in a lateral direction of the drawing to oscillate the membrane 12. As the piezoelectric material, for example, lead zirconate titanate may be used. Alternatively, various piezoelectric materials may be used such as bismuth iron oxide, metal niobate, barium titanate, or a product obtained by adding metal or another oxide to them.

However, vibration means for oscillating the membrane 12 is not limited to the piezoelectric element 13. For example, a material whose coefficient of linear expansion is different from that of the membrane 12 may be attached on the membrane 12 and the membrane 12 and the material may be heated. With this configuration, due to the difference in coefficients of linear expansion, it is possible to oscillate the membrane 12. At this time, it is preferable that the membrane 12 is oscillated by forming a heater at the material whose coefficient of linear expansion is different and heating the heater by flowing current.

The cells 350 are animal cells, in particular, human cells, for example. The cell suspension 300 contains cell dispersion liquid in addition to the cells 350. As the main component of the cell dispersion liquid, water, which has a high affinity with the cells 350, may be used. Further, it is preferable that the aqueous solution contains a salt for adjusting osmotic pressure with the cells 350 and a pH adjustor for adjusting pH. More specifically, as the cell dispersion liquid, pH adjusted Tris buffer solution or PBS (Phosphate buffered saline) solution in which a metallic salt such as Ca, K, Na or the like is similarly added as culture solution may be used.

Alternatively, as long as it is a cell culture medium that is generally used in this field, any cell culture media may be used as the cell dispersion liquid. For example, in accordance with the kind of the used cells 350, a basal medium described at page 581 of "technology of tissue culture edited by the Japanese Tissue Culture Association, third edition" published by Asakura Publishing Co., Ltd. such as a MEM culture medium, a BME culture medium, a DME culture medium, an αMEM culture medium, an IMDM culture medium, an ES culture medium, a DM-160 culture medium, a Fisher culture medium, an F12 culture medium, a WE culture medium, an RPMI1640 culture medium or the like may be used.

Further, serum (fetal bovine serum or the like), various growth factors, antibiotic, amino acid or the like may be added to the basal medium. Further, a commercially available serum-free culture medium or the like such as a GIBCO serum-free culture medium (Invitrogen corporation) or the like may be used. When considering a clinical application of the finally obtained cell tissues, it is preferable to use a culture medium that does not contain animal components.

(Droplet Forming Process of Droplet Forming Apparatus)

Figure 2:
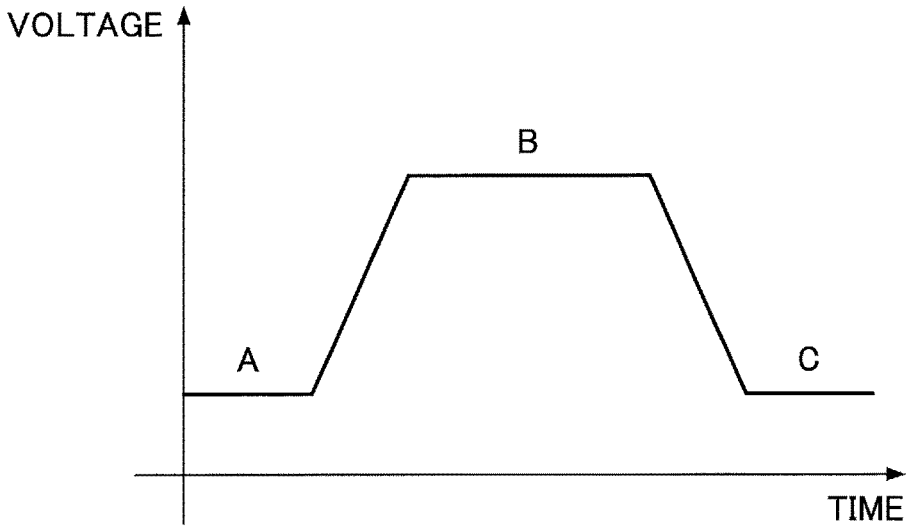
FIG. 2 is a view illustrating an example of voltage applied to upper and lower electrodes of a piezoelectric element.
Figure 3A:
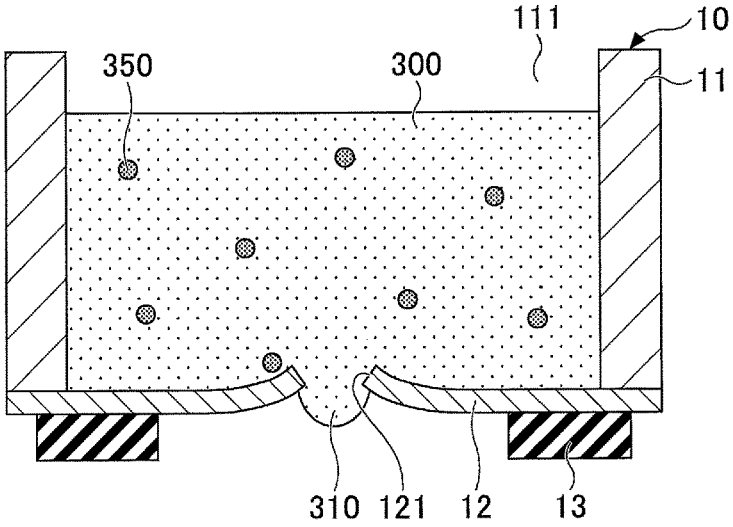
FIG. 3A to FIG. 3C are views illustrating an example of processes in which a droplet is formed.
Figure 3B:
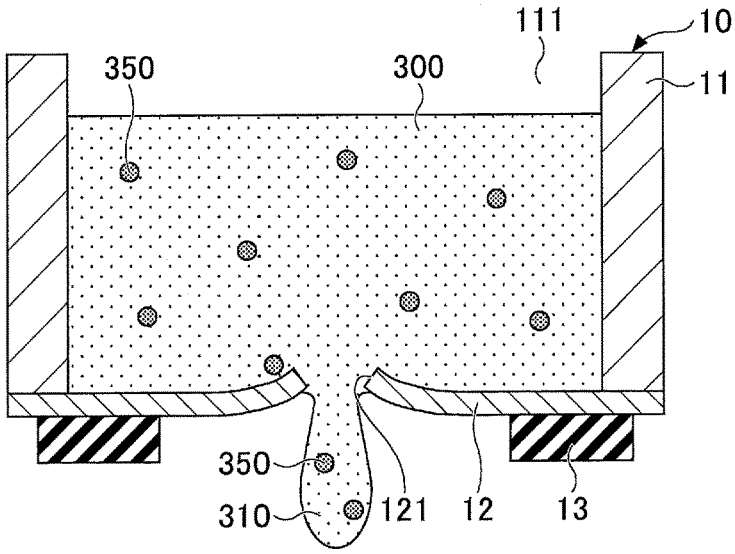
Figure 3C:
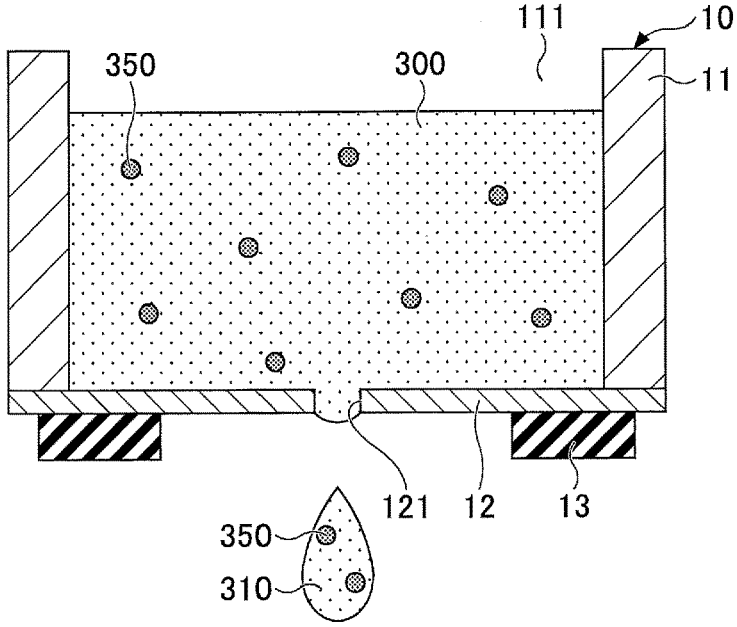

Next, processes in which the droplet is formed by the droplet forming apparatus 10 of the first embodiment are explained. FIG. 2 is a view illustrating an example of voltage applied to the upper and lower electrodes of the piezoelectric element 13. FIG. 3A to FIG. 3C are views illustrating an example of processes in which a droplet is formed.

When the pulse-like voltage illustrated in FIG. 2 is applied to the upper and lower electrodes of the piezoelectric element 13 of the droplet forming apparatus 10, a droplet 310 is formed as illustrated in FIG. 3A to FIG. 3C. First, at timing "A" of FIG. 2, as illustrated in FIG. 3A, the membrane 12 is drastically deformed. Thus, a high pressure is generated between the cell suspension 300 retained in the liquid chamber 11 and the membrane 12, Then, due to this pressure, the droplet 310 is extruded outside from the nozzle 121.

Next, at timing "B" of FIG. 2, as illustrated in FIG. 3B, the liquid is continuously extruded from the nozzle 121 during a period until the pressure is absorbed upward, and the droplet 310 grows. Finally, at timing "C" of FIG. 2, as illustrated in FIG. 3C, the liquid pressure near an interface of the cell suspension 300 and the membrane 12 is lowered when the membrane 12 is recovered to an original state and the droplet 310 containing the cells 350 is formed.

In the droplet forming apparatus 10, the bubbles may be mixed in the cell suspension 300 in the liquid chamber 11. However, as the open portion 111 is provided at the upper portion of the liquid chamber 11 of the droplet forming apparatus 10, the bubbles mixed in the cell suspension 300 can be ejected to external air through the open portion 111. With this configuration, it is possible to continuously and stably form the droplet 310 without throwing large amount of liquid away in order to eject the bubbles.

In other words, it is necessary to eject the mixed bubbles in order to stably form a droplet for a long period, because if the bubbles are mixed near the nozzle 121, or many bubbles are mixed on the membrane 12, they influence a discharging state. Generally, the bubbles mixed on the membrane 12 move upward automatically or by the oscillation of the membrane 12. Then, as the liquid chamber 11 is provided with the open portion 111, the mixed bubbles can be ejected from the open portion 111.

Here, at timing when the droplet is not intended to be formed, the membrane 12 may be oscillated within a range that a droplet is not formed to actively move the bubbles upward in the liquid chamber 11.

As such, as the droplet forming apparatus 10 of the first embodiment includes the open portion 111 that opens inside the liquid chamber 11 to atmosphere, even when the bubbles are mixed in the liquid chamber 11, the bubbles can be ejected to the external air through the open portion 111. Thus, different from an inkjet head including a general pressure liquid chamber, even when the bubbles are mixed in the liquid chamber 11, it is possible to prevent a phenomenon that the liquid cannot be discharged, and the droplet 310 can be continuously stably formed.

Alternative Example 1 of First Embodiment

In the alternative example 1 of the first embodiment, an example of a droplet forming apparatus including a liquid providing unit or a liquid amount detection unit is described. Here, in the alternative example 1 of the first embodiment, the same components are given the same reference numerals as those explained above, and explanations are not repeated.

Figure 4:
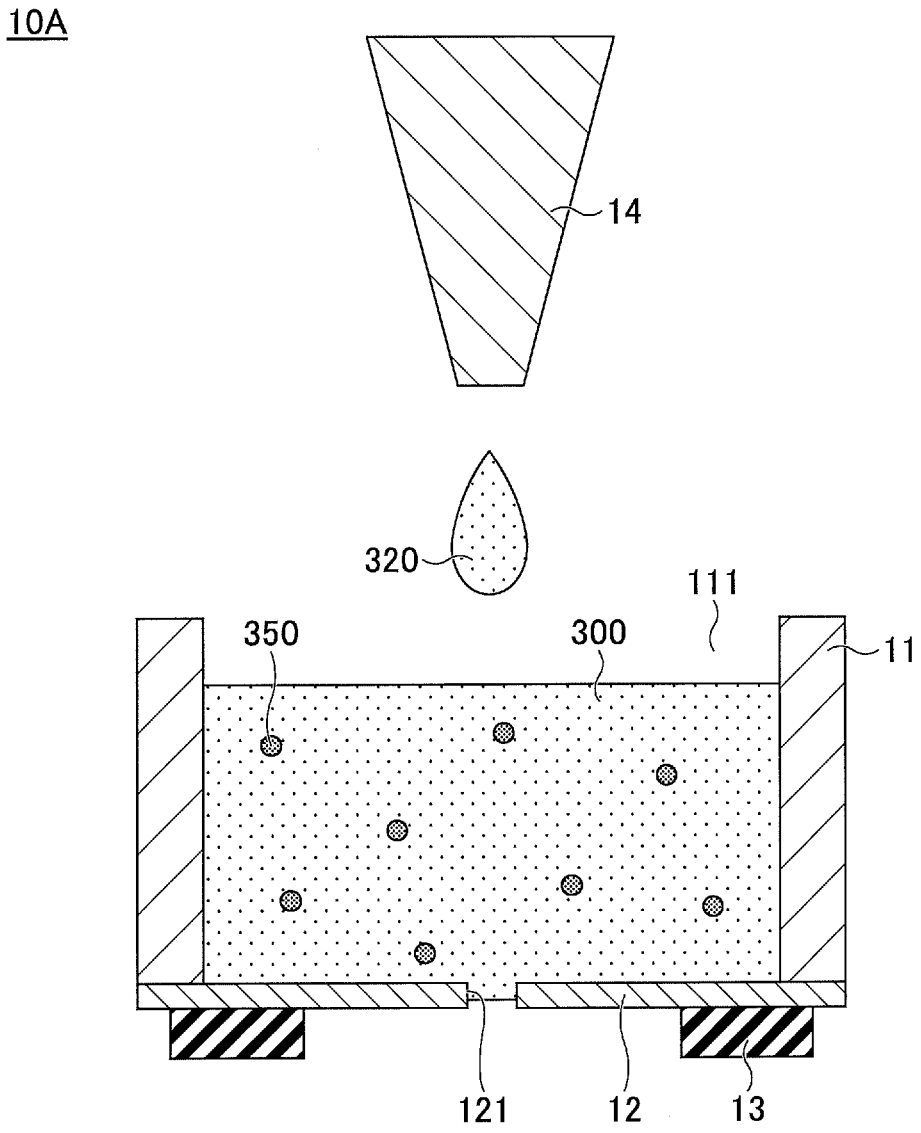
FIG. 4 is a cross-sectional view (No. 1) illustrating an example of a droplet forming apparatus of an alternative example 1 of the first embodiment.

FIG. 4 is a cross-sectional view (No. 1) illustrating an example of a droplet forming apparatus 10A of an alternative example 1 of the first embodiment, in which an example of a droplet forming apparatus including a liquid providing unit is illustrated. With reference to FIG. 4, the droplet forming apparatus 10A is configured to directly provide liquid 320 (that is stored in the liquid chamber 11 to be the cell suspension 300) from the open portion 111 by a micropipette 14. With this configuration, it is possible to directly provide very small amount of cell suspension 300 (about 10 μl, for example) in the droplet forming apparatus 10A and the valuable solution can be effectively used.

Here, the liquid providing unit is not limited to the micropipette 14 and a syringe, a tube or the like may be used as the liquid providing unit. Further, a user may appropriately manually provide the liquid 320 or a system that automatically provides the liquid may be used in combination. Here, the micropipette 14, the syringe and the tube are a typical example of the liquid providing unit.

When the liquid is automatically provided, for example, the droplet forming apparatus may include a liquid amount detection unit that detects the liquid amount of the retained cell suspension 300, and the liquid may be provided in accordance with the position of a liquid level. Alternatively, the number of times that the droplet is discharged may be counted and the liquid may be automatically provided after the predetermined times of discharging operation are performed.

Figure 5:
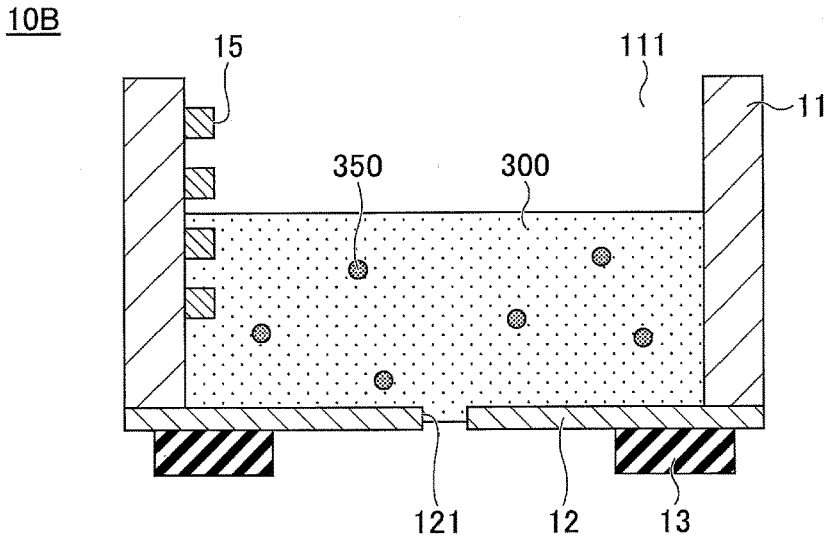
FIG. 5 is a cross-sectional view (No. 2) illustrating an example of the droplet forming apparatus of the alternative example 1 of the first embodiment.

FIG. 5 is a cross-sectional view (No. 2) illustrating an example of a droplet forming apparatus 10B of the alternative example 1 of the first embodiment. FIG. 5 illustrates an example of a droplet forming apparatus including a liquid amount detection unit. In the droplet forming apparatus 10B illustrated in FIG. 5, a plurality of electrodes 15 are provided at an inner wall surface of the liquid chamber 11 in a depth direction. As the cell suspension 300 is generally aqueous solution containing salts, its conductivity is high. Thus, it is possible to detect the liquid amount of the cell suspension 300 by checking the electrical connection or resistance values between the plurality of electrodes 15.

Figure 6:
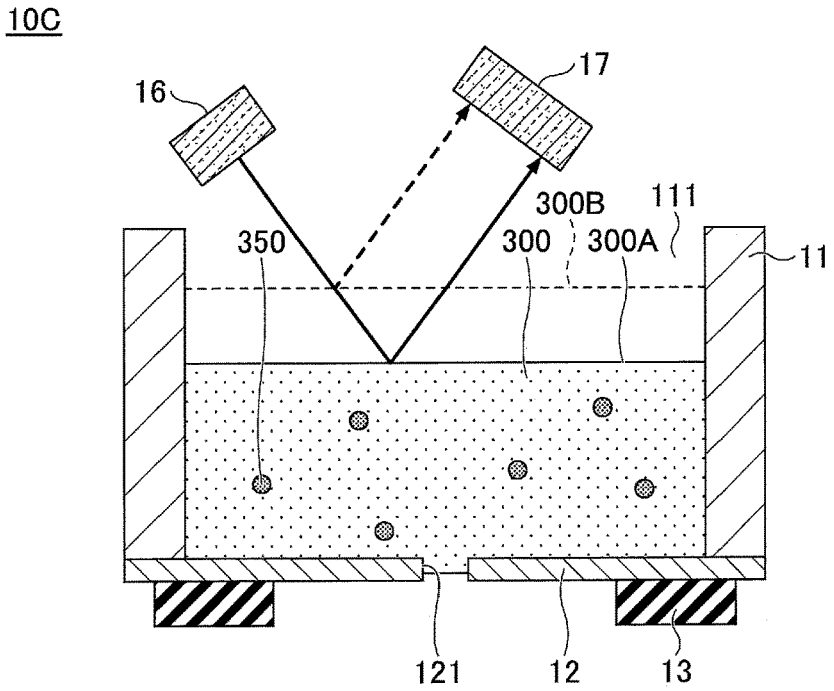
FIG. 6 is a cross-sectional view (No. 3) illustrating an example of the droplet forming apparatus of the alternative example 1 of the first embodiment.

FIG. 6 is a cross-sectional view (No. 3) illustrating an example of a droplet forming apparatus 100 of the alternative example 1 of the first embodiment, in which another example of a droplet forming apparatus including a liquid amount detection unit is illustrated. In the droplet forming apparatus 10C illustrated in FIG. 6, a light emitting device 16 and a position sensor 17, which are a liquid amount detection unit, are provided above the liquid chamber 11.

The position sensor 17 is provided at a position capable of receiving light that is irradiated from the light emitting device 16 and is regularly reflected at a liquid level 300A or a liquid level 300B of the cell suspension 300. With this configuration, a distance to a liquid level of the cell suspension 300 can be calculated based on a position at which the position sensor 17 receives the light using the principal of triangulation. Further, it is possible to convert the signal of the position sensor 17 to the liquid amount of the cell suspension 300 based on a previously set conversion formula or a look-up-table.

As such, the droplet forming apparatus 10A of the alternative of the example 1 of the first embodiment includes a liquid providing unit that directly provides the liquid from the open portion 111 in the liquid chamber 11. With this configuration, it is possible to provide the cell suspension 300 in the liquid chamber 11 only when it is necessary and only for the necessary amount and the droplet can be formed by a small amount of the liquid. This is very important for the droplet forming apparatus 10A that handles the cells 350 that are generally not easily obtainable, very expensive, and are difficult to be retained in the liquid chamber 11 for long time.

Further, each of the droplet forming apparatuses 10B and 10C of the alternative example 1 of the first embodiment includes the liquid amount detection unit that detects the liquid amount of the cell suspension 300. With this configuration, it is possible to automatically provide the liquid in accordance with the position of the liquid level of the cell suspension 300, or in accordance with the number of times that the droplet is discharged, and convenience of the user can be improved.

Alternative Example 2 of First Embodiment

In the alternative example 2 of the first embodiment, an example of a droplet forming apparatus including a unit that prevents drying of the cell suspension is described. In the alternative example 2 of the first embodiment, the same components are given the same reference numerals as those explained above, and explanations are not repeated.

As described above, it is important to eject the bubbles in order to stably discharge the cell suspension 300. However, it is also important to provide a unit that prevents drying of the cell suspension because cells generally have weak resistance against drying. There is a case for the cell suspension 300 that the solvent includes salts in order to adjust the osmotic pressure with inside the cells, or that animal cells are used as the cells each of which is partitioned by a cell membrane. At this time, in particular, drying becomes a problem.

In the droplet forming apparatus 10 (see FIG. 1), as the cell suspension 300 retained in the liquid chamber 11 contacts the external air, the moisture evaporation to the external air occurs from a contacting interface. By the moisture evaporation, an area with a low moisture content is locally formed and flowing out of intracellular moisture occurs, due to drying or aggregation of cells or increasing of a salt concentration. Thus, although it is desirable that the cell suspension 300 contacts the external air from a viewpoint of ejecting the bubbles, meanwhile, there is a need to suppress the moisture evaporation to the external air.

Further, there is a case that the droplet forming apparatus 10 is used in a biological research, and in such a case, it becomes a problem if funguses, cells, viruses, other proteins or the like are mixed in the cell suspension 300 from outside. Thus, it is preferable that the contact with the external air is suppressed as small as possible in order to prevent contamination from outside. Thus, each of the droplet forming apparatuses of the embodiment may include a unit to prevent drying of the cell suspension.

Figure 7A:
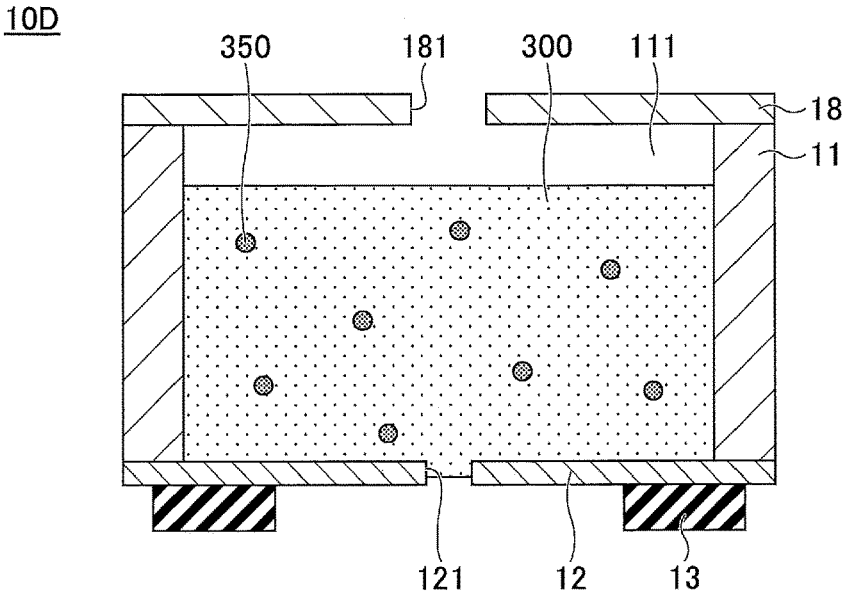
FIG. 7A and FIG. 7B are cross-sectional views illustrating an example of a droplet forming apparatus of an alternative example 2 of the first embodiment.
Figure 7B:
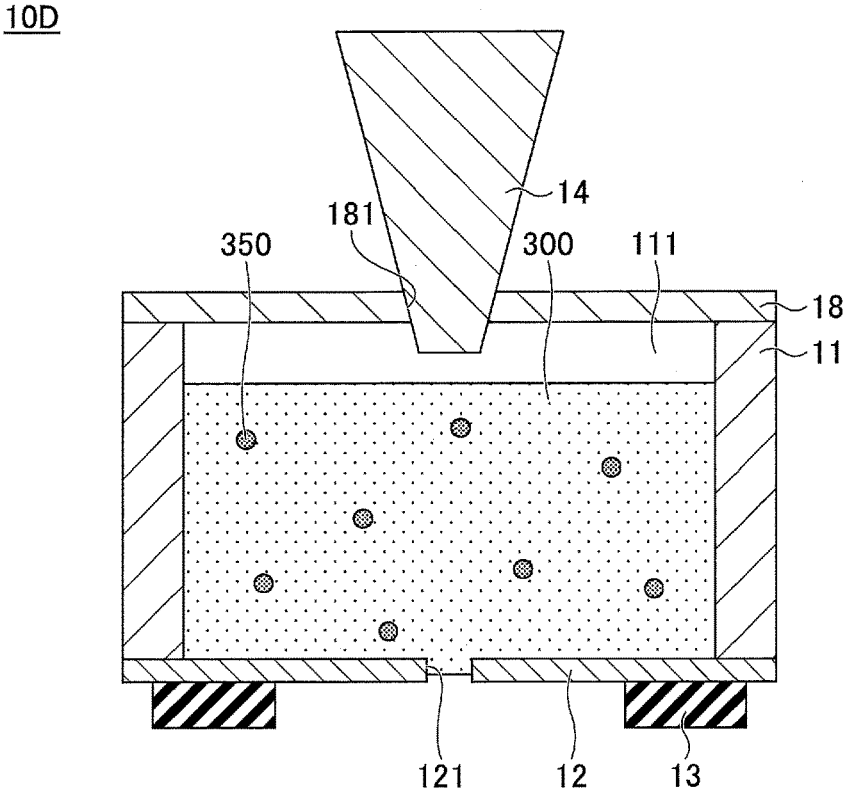

FIG. 7A and FIG. 7B are cross-sectional views illustrating an example of a droplet forming apparatus 10D of an alternative example 2 of the first embodiment, in which an example of a droplet forming apparatus including a drying preventing unit is illustrated. With reference to FIG. 7A, in the droplet forming apparatus 10D, a top cover 18 is provided above the liquid chamber 11. Further, the top cover 18 is provided with a through hole 181 through which the open portion 111 communicates with atmosphere. The through hole 181 is a small hole whose cross-section is smaller than that of the liquid chamber 11.

By providing the top cover 18 provided with the through hole 181 on the liquid chamber 11, the area of the open portion 111 that communicates with atmosphere decreases. Thus, it is possible to retain the humidity right above the cell suspension 300 to be higher than that of the external air, and the moisture evaporation can be suppressed as small as possible.

Here, in the droplet forming apparatus 10A of FIG. 4, a problem may occur if a front end position of the micropipette 14 is not determined when automatically or manually providing the liquid 320 using the micropipette 14. For example, scattering of the liquid when the position of the micropipette 14 is too high, a damage to the membrane 12 when the position of the micropipette 14 is too low, or the like.

As illustrated in FIG. 7B, in the droplet forming apparatus 10D, by pressing the micropipette 14 through the through hole 181 formed in the top cover 18, a front end of the micropipette 14 is positioned at an approximately the same position. With this configuration, scattering of the liquid or a damage to the membrane 12 due to the variation of the front end position of the micropipette 14 can be prevented. Here, in this case, it is preferable that the shape of the through hole 181 is designed in accordance with the shape of the micropipette 14 used by the user.

As such, in the droplet forming apparatus 10D of the alternative example 2 of the first embodiment, the top cover 18 is provided above the liquid chamber 11. Further, the top cover 18 is provided with a small hole, whose cross-section is smaller than that of the liquid chamber 11, that permits the open portion 111 to communicate with atmosphere.

With this configuration, the amount of moisture evaporation in the liquid chamber 11 can be suppressed as small as possible. Thus, flowing out of intracellular moisture from the cells 350 because of a fact that the salt concentration at a gas-liquid interface in the liquid chamber 11 becomes high due to drying can be suppressed, and damages to the cells 350 can be decreased. This means that a possibility can be decreased that activities of the cells 350 are lowered due to moisture drying of the cell suspension 300 and the cells 350 are dead.

Here, the light emitting device 16 and the position sensor 17 of the alternative example 1 of the first embodiment may be provided at a lower surface side (an inner side of the liquid chamber 11) of the top cover 18. With this configuration, the liquid amount of the cell suspension 300 can be detected as well as obtaining a drying preventing effect by the top cover 18.

Alternative Example 3 of First Embodiment

In the alternative example 3 of the first embodiment, an example of a droplet forming apparatus including an opening/shutting mechanism for opening and shutting the open portion in order to prevent drying of the cell suspension is described. In the alternative example 3 of the first embodiment, the same components are given the same reference numerals as those explained above, and explanations are not repeated.

As described above, the droplet forming apparatus of the alternative example 2 of the first embodiment includes the drying preventing unit in order to avoid the problem caused by drying of the cell suspension. Further, it is preferable that an opening/shutting mechanism capable of opening and shutting the communication with atmosphere at the open portion of the droplet forming apparatus is provided.

Figure 8:
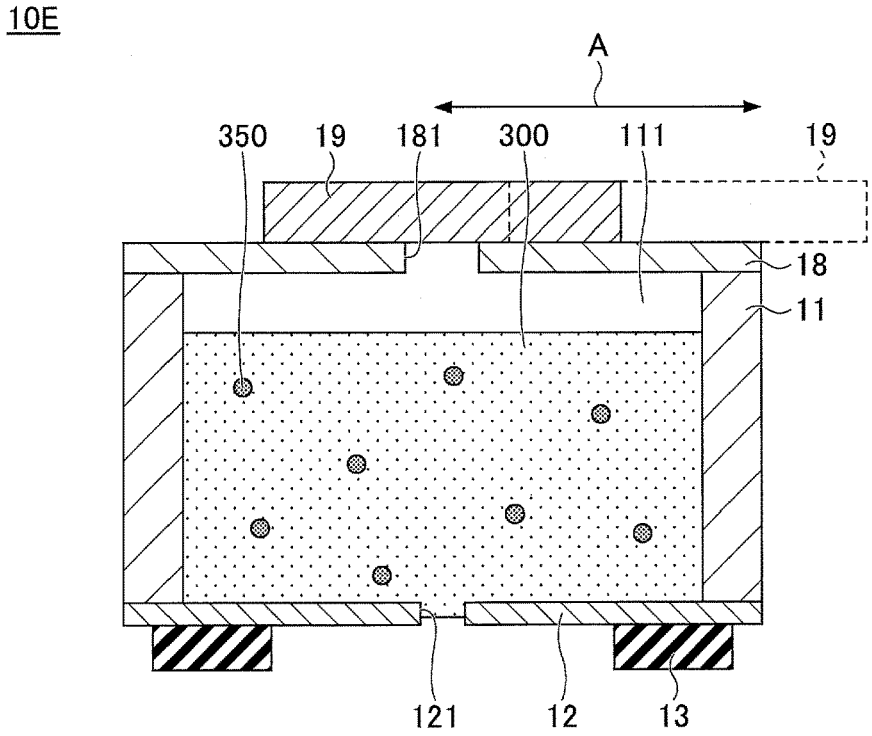
FIG. 8 is a cross-sectional view (No. 1) illustrating an example of a droplet forming apparatus of an alternative example 3 of the first embodiment.

FIG. 8 is a cross-sectional view (No. 1) illustrating an example of a droplet forming apparatus 10E of an alternative example 3 of the first embodiment which includes an opening/shutting mechanism 19. With reference to FIG. 8, in the droplet forming apparatus 10E, the opening/shutting mechanism 19 is further provided on the top cover 18. Although the structure of the opening/shutting mechanism 19 is not specifically limited, for example, the opening/shutting mechanism 19 may have a mechanism in which the open portion 111 is opened or shut by sliding a plate in a direction of an arrow "A" (lateral direction) through a slide guide that is formed on the top cover 18.

By providing the opening/shutting mechanism 19, it is possible to open the open portion 111 only when supplying the liquid and shut the open portion 111 other than that. Thus, it is possible to suppress moisture drying as small as possible at normal time (when forming the droplet 310). Further, mixing of funguses, cells, viruses or the like from outside in the cell suspension 300 may be suppressed as small as possible.

Here, it is preferable that inside the droplet forming apparatus is not completely sealed by the opening/shutting mechanism. If inside the droplet forming apparatus is completely sealed, the pressure in the droplet forming apparatus and the outside pressure become different due to lowering of the liquid amount, temperature change, outside pressure change or the like. If the pressures are different inside and outside the droplet forming apparatus, a shape of the liquid level of the nozzle may be changed and the discharging state may be changed. In particular, if inside the droplet forming apparatus becomes a negative pressure state, the bubbles may be easily mixed. Thus, even when the open portion is shut by the opening/shutting mechanism, it is preferable that inside the droplet forming apparatus does not become a negative pressure state.

Figure 9:
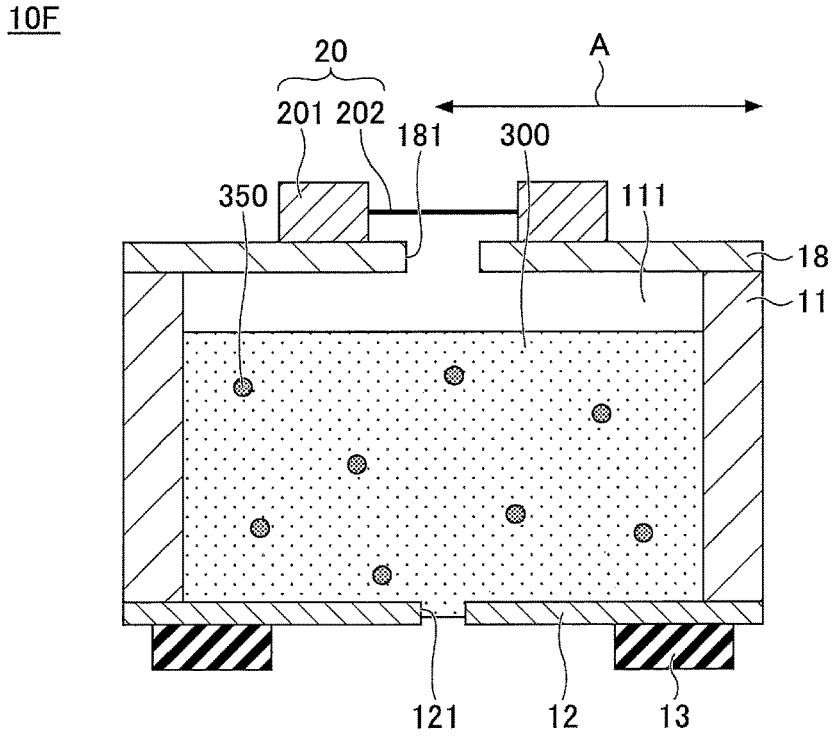
FIG. 9 is a cross-sectional view (No. 2) illustrating an example of the droplet forming apparatus of the alternative example 3 of the first embodiment.

FIG. 9 is a cross-sectional view (No. 2) illustrating an example of a droplet forming apparatus 10F of an alternative example 3 of the first embodiment, in which another example of a droplet forming apparatus including an opening/shutting mechanism is illustrated. With reference to FIG. 9, in the droplet forming apparatus 10F, an opening/shutting mechanism 20 is provided on the top cover 18. The opening/shutting mechanism 20 includes a polymer membrane 202 that is retained by a polymer membrane retaining unit 201. The opening/shutting mechanism 20 is configured to be slidable in a direction of an arrow "A" (lateral direction). The polymer membrane 202 is a film whose moisture permeability is low but whose gas permeability is high.

By providing the opening/shutting mechanism 20, it is possible to maintain the pressures inside and outside the droplet forming apparatus 10F equally while suppressing the moisture evaporation as small as possible.

Figure 10:
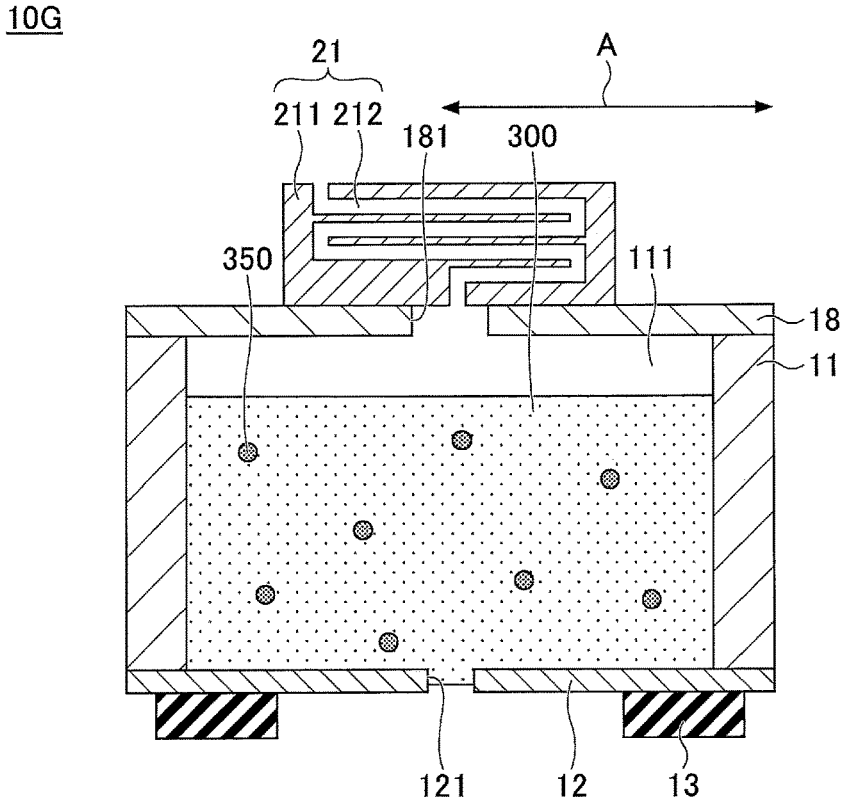
FIG. 10 is a cross-sectional view (No. 3) illustrating an example of the droplet forming apparatus of the alternative example 3 of the first embodiment.

FIG. 10 is a cross-sectional view (No. 3) illustrating an example of a droplet forming apparatus 10G of an alternative example 3 of the first embodiment, in which yet another example of a droplet forming apparatus including an opening/shutting mechanism is illustrated. With reference to FIG. 10, in the droplet forming apparatus 10G, an opening/shutting mechanism 21 is provided on the top cover 18. A flow channel 212 (snake line) that is thinly bent as winding (zigzag) is provided in a main body 211 of the opening/shutting mechanism 21. The opening/shutting mechanism 21 is configured to be slidable in a direction of an arrow "A" (lateral direction).

The flow channel 212 is formed such that its cross-section is smaller than the cross-section of the liquid chamber 11 and the cross-section of the through hole 181. When the opening/shutting mechanism 21 is shut, the open portion 111 communicates with atmosphere through the flow channel 212. Then, when the opening/shutting mechanism is opened, the open portion 111 communicates with atmosphere through the through hole 181, not through the flow channel 212.

By providing the opening/shutting mechanism 21, the pressure in the droplet forming apparatus 10G can be retained equally as the outside pressure through the flow channel 212. Further, as the moisture in the droplet forming apparatus 10G is diffused to the external air through the flow channel 212 taking a long period, it is possible to suppress moisture evaporation in the droplet forming apparatus 10G.

Figure 11:
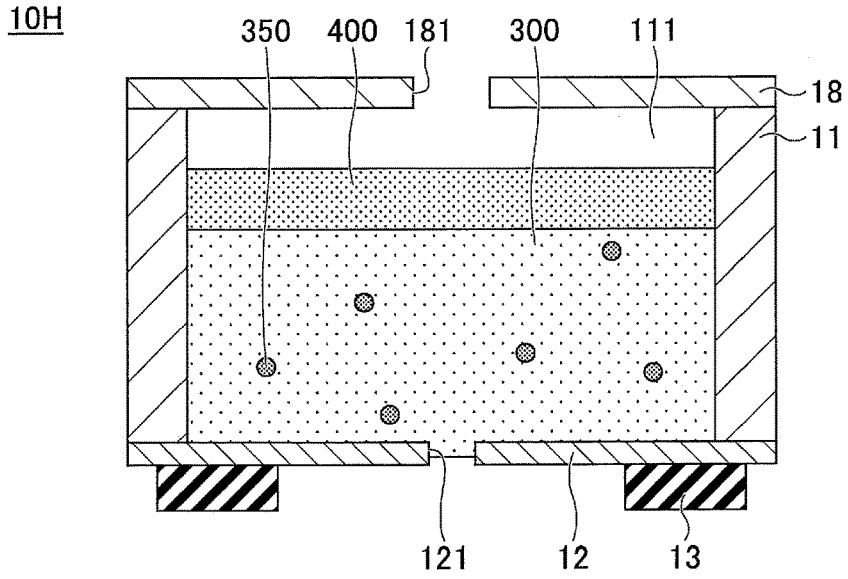
FIG. 11 is a cross-sectional view (No. 4) illustrating an example of the droplet forming apparatus of the alternative example 3 of the first embodiment.

FIG. 11 is a cross-sectional view (No. 4) illustrating an example of the droplet forming apparatus of an alternative example 3 of the first embodiment, in which an example of a droplet forming apparatus including a specific layer structure of cell suspension instead of the opening/shutting mechanism is illustrated. With reference to FIG. 11, in the droplet forming apparatus 10H, a solvent layer 400 whose specific gravity is lighter than that of the cell suspension 300 is formed on the cell suspension 300 retained in the liquid chamber 11. Here, in the droplet forming apparatus 10H, the top cover 18 may be provided in accordance with necessity.

As the solvent layer 400, a material that has a low affinity with water, which is the main solvent of the cell suspension 300, and that is barely dissolved (that does not have solubility to water) in the water may be used. Typically, it is appropriate to use various oils, in particular, biological oils that have a high affinity with biological components. Further, in order to stabilize the interface between the cell suspension 300 and the oil, a layer of amphipatic molecules (surface active agent) may be formed.

As such, when the liquid chamber 11 retains the solvent layer 400 whose specific gravity is lighter than that of the cell suspension 300 and that does not have solubility to the main solvent of the cell suspension 300 at the upper surface of the cell suspension 300, the following advantages can be obtained. It is possible to suppress the moisture evaporation in the cell suspension 300, and it is possible to eject the bubbles that are moved in the cell suspension 300 upward by passing through the solvent layer 400 to the external air.

Further, even when the cell suspension 300 is provided from the upper side, as the cell suspension 300 is heavier than the solvent layer 400, the cell suspension 300 passes through the solvent layer 400. Thus, the layer of the cell suspension 300 can be easily formed at the lower side of the solvent layer 400.

According to the embodiment, a droplet forming apparatus capable of stably discharging cell suspension can be provided.

Although a preferred embodiment of the droplet forming apparatus has been specifically illustrated and described, it is to be understood that minor modifications may be made therein without departing from the spirit and scope of the invention as defined by the claims.

The present invention is not limited to the specifically disclosed embodiments, and numerous variations and modifications may be made without departing from the spirit and scope of the present invention.

For example, when assuming that plane of the membrane 12, which is not deformed, as XY-directions and a direction that is normal to the membrane 12 as a Z direction, a mechanism may be provided that can move the droplet forming apparatus 10 independently in the X-direction, the Y-direction and the Z direction. With this configuration, it is possible to easily pattern cells in the XY plane, or stack cells in the Z direction.

The present application is based on and claims the benefit of priority of Japanese Priority Application No. 2014-259120 filed on Dec. 22, 2014, the entire contents of which are hereby incorporated by reference.

What is claimed is:

1. A droplet forming apparatus comprising:

a liquid retaining portion that retains cell suspension containing cells;

a membrane member, provided with a nozzle, that discharges the cell suspension retained in the liquid retaining portion from the nozzle as a droplet by oscillation;

an open portion that opens the liquid retaining portion to atmosphere;

a liquid amount detection unit that detects a position of a liquid level of the cell suspension in the liquid retaining portion; and a liquid providing unit provided above the open portion to directly provide the cell suspension from the open portion to the liquid retaining portion in accordance with the position of the liquid level of the cell suspension detected by the liquid amount detection unit.

2. The droplet forming apparatus according to claim 1, further comprising:

a top cover provided above the liquid retaining portion, wherein the top cover is provided with a hole whose cross-section is smaller than that of the liquid retaining portion for having the open portion communicating with atmosphere.

3. The droplet forming apparatus according to claim 1, further comprising:

a slidable member provided above the liquid retaining portion to open and shut the open portion by sliding with respect to the liquid retaining portion.

4. The droplet forming apparatus according to claim 3, wherein the slidable member includes a main body in which a bent flow channel is provided, wherein the cross-section of the flow channel is smaller than the cross-section of the liquid retaining portion, wherein the open portion communicates with atmosphere through the flow channel when the slidable member shuts the open portion, and wherein the open portion communicates with the atmosphere without passing through the flow channel when the slidable member opens the open portion.

5. The droplet forming apparatus according to claim 1, wherein the liquid retaining portion contains a solvent layer whose specific gravity is lighter than that of the cell suspension and that does not have solubility to a main solvent of the cell suspension, at an upper surface of the cell suspension.

6. The droplet forming apparatus according to claim 1, wherein the liquid amount detection unit includes a first electrode and a second electrode provided at an inner wall surface of the liquid retaining portion with a space therebetween in a depth direction, and is configured to detect the liquid level of the cell suspension by checking an electrical connection or resistance values between the first electrode and the second electrode.

7. The droplet forming apparatus according to claim 1, wherein a material of the membrane member is a ceramic material, a high polymer material or a fluororesin material, or a surface of a material of the membrane member is coated by a metal oxide material or a synthesized phospholipid polymer material.

* * * * *